United States Patent [19]

Benner

[11] Patent Number: 4,882,878

[45] Date of Patent: Nov. 28, 1989

[54] GRINDING WHEEL

[76] Inventor: Robert L. Benner, 4 Valley Dr., Chalfont, Pa. 18914

[21] Appl. No.: 228,890

[22] Filed: Aug. 5, 1988

[51] Int. Cl.[4] ..... B24D 5/00

[52] U.S. Cl. ..... 51/206 R; 51/209 R; 51/266

[58] Field of Search ..... 51/204, 206 R, 207, 51/209 R, 209 DL, 266, 267, 395, 398, 402, 404, 296

[56] References Cited

U.S. PATENT DOCUMENTS

| | | | |
|---|---|---|---|
| Re. 19,802 | 12/1935 | Pohl et al. | 51/298 |
| 494,471 | 3/1893 | Gardner | 51/206 R |
| 494,472 | 3/1893 | Gardner | 51/206 R |
| 816,461 | 3/1906 | Gorton | 51/395 |
| 1,622,942 | 3/1927 | Chase | 51/209 S |
| 1,986,849 | 1/1935 | Pohl et al. | 51/206 R |
| 1,986,850 | 1/1935 | Pohl et al. | 51/206. R X |
| 2,123,581 | 7/1938 | Anderson | 51/404 |
| 2,347,244 | 4/1944 | Colt et al. | 51/294 |
| 2,376,254 | 5/1945 | Humphrey et al. | 51/309 |
| 2,627,145 | 2/1953 | Frigstad | 51/396 |
| 2,705,194 | 3/1955 | St. Clair | 51/293 |
| 2,740,239 | 4/1956 | Ball et al. | 51/404 |
| 2,749,681 | 6/1956 | Reidenbach | 51/395 |
| 2,755,601 | 7/1956 | Lux | 51/206 R |
| 2,755,607 | 7/1956 | Haywood | 51/395 |
| 2,818,694 | 1/1958 | Tocci-Guilbert | 51/404 |
| 2,838,890 | 6/1958 | McIntyre | 51/395 |
| 2,886,923 | 5/1959 | LaFrance | 51/383 |
| 2,986,455 | 5/1961 | Sandmeyer | 51/298 |
| 3,041,799 | 7/1962 | Kemman | 51/209 R |
| 3,121,299 | 2/1964 | Fye | 51/209 R |
| 3,203,775 | 8/1965 | Cantrell | 51/296 |
| 3,273,984 | 9/1966 | Nelson | 51/296 |
| 3,324,608 | 6/1967 | Hoenig | 51/395 |
| 3,329,488 | 7/1967 | Cofran | 51/296 |
| 3,343,308 | 9/1967 | Fessel | 51/395 |
| 3,386,214 | 6/1968 | Shoemaker | 51/209. R X |
| 3,420,007 | 1/1969 | Kolesh | 51/209 R |
| 3,495,359 | 2/1970 | Smith et al. | 51/204 |
| 3,495,362 | 2/1970 | HJillenbrand | 51/395 |
| 3,522,680 | 8/1970 | Sarofeen | 51/358 |
| 3,718,447 | 2/1973 | Hibbs, Jr. et al. | 51/295 |
| 3,835,598 | 9/1974 | Tobey | 51/396 |
| 4,385,907 | 5/1983 | Tomita et al. | 51/296 |
| 4,547,998 | 10/1985 | Kajiyama | 51/206 R |

OTHER PUBLICATIONS

"Diamond Abrasive for Machining Glass" *Industrial Diamond Review* 4/87 pp. 159–162.

"New Discs Solve Problems in Preparation of Samples", Harry E. Chandler, *Metal Progress,* Sep. 1982, pp. 69, 70.

"Recent Developmnets in Production with Diamond" Published DeBeers Inductrial Diamond Divison, London, Jul. 2, 1968, p. 1 and pp. 4 thru 8.

TBW Industries, Inc. advertising brochure VIS-A-BRADE (no Date).

TBW Industries advertising brochure "Manufacture of: Abrasive Cutting Systems" (no date).

*Primary Examiner*—Robert P. Olszewski

*Attorney, Agent, or Firm*—Eugene Chovanes

[57] ABSTRACT

Improved rigid grinding wheels are described which have a rigid organic matrix binding particulate diamond or cubin boron nitride abrasive uniformly dispersed therein between a plurality of spaced-apart apertures extending inwardly from the operative grinding surface of the matrix. The cross-sectional open area of the apertures in the matrix reduces the operative solid grinding surface and provides swarf relief while also increasing the effective concentration of a given amount of abrasive in the griding surface, this increasing the efficiency of the grinding wheel while reducing the cost of the wheel and power consumption in use.

1 Claim, 2 Drawing Sheets

GRINDING WHEEL

BACKGROUND OF THE INVENTION

This invention relates to an improvement in abrading tools and, in particular, to wheel or disk type abrading tools and most particularly to rigid diamond or cubic boron nitride grinding wheels of increased efficiency and lower cost.

The grinding wheel art is highly developed and of long standing as is evidenced by standard texts such as *The Grinding Wheel,* A Textbook of Modern Grinding Practice by Kenneth B. Lewis, published by The Judson Company, Cleveland, Ohio, 1951, revised edition 1959, under the auspices of the Grinding Wheel Institute. The art of grinding, to which the present invention pertains, including its history, prior development, and the practice current at that time, is described in Chapter 19 of the Lewis work, supra.

In the past, as described by T. Pohl et al, U.S. Reissue Pat. No. 19,802 issued Dec. 31, 1935, abrading materials were interspersed in a matrix containing substantial amounts of preferably uniformly formed cells or holes separated from each other by walls of the abrading mixture; i.e., the abrading material was distributed throughout a porous matrix. The cells or holes could be of various shapes such as ball-like, cylindrical or other, and the size could vary over a wide range. The form and size of the cells was controlled to a considerable extent by the particular abrading material used, the binding material, and by the type of work to which the grinding tool was to be subjected.

The optimum size and form of the cells and their relation to the size of the abrading material was determined by empirical testing. The Pohl patent specifically describes a grinding disk having a honeycomb formation in which hollow cells are uniformly distributed throughout the entire disk, the cells being surrounded by comparatively thin wall of the selected matrix and abrading material. The cells extended from the periphery of the disk to the axis, and each cell was generally cylindrical or ball-shaped. Such abrading disks were said to have many advantages over previous grinding disks, since as the abrading particles and matrix of the cellular structure wore away, new hollow cells continuously opened to expose fresh cutting edges. Inasmuch as the hollow spaces or cells were substantially large as compared to the particles moved from the material being ground, the cells were not clogged dby this extraneous matter, thus providing what is known in the art as swarf relief.

Similarly, Smith et al U.S. Pat. No. 3,495,359, issued Feb. 17, 1970 describes a core drill structure having a perforate supporting body with diamond abrasive adhered to all surfaces of the working portion intermediate the perforations in the body. This reference described prior diamond impregnated tools in which a mixture of bond and diamond grits was molded to the desired shape before the bond was set. It was noted that various types of ceramic and resin bonds had been used for this purpose, but that it had been preferred to use particulate metal alloy bond components, i.e. powder metalurgy type for the most difficult cutting operations. Smith et al also noted that various designs had been provided to permit free circulation of flushing fluids to wash away the swarf in such drilling operations. It was said that such swarf relief was essential to cool the tool and clear the debris in front of the tool so that the diamond particles in the exposed end of the tool could be pressed against the material being cut. Smith et al specifically described tools in which a cylindrical core member, as the working portion of the core drill, was formed of a sheet of woven metal design, or a tubular seamless wire mesh braid. The perforations in the member or holes in the woven screen and braid were arranged in a pattern so that in any plane the apertures overlapped one another. By placing the diamond grits on all surfaces of the sides of the working end of the braid, screen or perforated member, a substantially three-dimensional distribution of diamond particles was obtained so that as the tool wore in use, new diamond particles were exposed.

While the foregoing disclosures were significant advances in the art, it has long been apparent that further improvements were needed to increase the efficiency and lower the cost of production and operation of such grinding tools.

OBJECTS OF THE INVENTION

It is a primary object of the present invention, therefore, to provide grinding tools having improved efficiency and reduced cost.

It is another object of the invention to provide grinding tools which increase the rate of grinding, reducing the amount of expensive abrasive, such as diamond or cubic boron nitride, required.

It is a particular object of the invention to provide improved rigid grinding wheels comprising diamond or cubic boron nitride abrasive in a rigid organic matrix which, for a given amount of the expensive abrasive, provide increased efficiency at reduced cost; specifically, reduced power consumption, increased rate of grinding, and reduced amount of expensive abrasive in the manufacture of the wheel.

BRIEF DESCRIPTION OF THE DRAWINGS

Reference is now made to the accompanying drawings for a better understanding of the nature and objects of the invention. The drawings illustrate the best mode presently contemplated for carrying out the objects of the invention and its principles, and are not to be construed as limiting, inasmuch as other embodiments will be described below and still others will be apparent to those skilled in the art.

In the drawings.

SUMMARY OF THE INVENTION

The foregoing and other objects of the invention, which will become apparent below, are achieved by providing a rigid grinding wheel comprising a rigid matrix containing a predetermined amount of particulate diamond or cubic boron nitride abrasive material, preferably uniformly dispersed in a conventional rigid organic matrix; the matrix having a grinding surface continually as the matrix wears away during use in the grinding operation. Hereinafter the term "diamond" will be used, for simplicity of explanation, to indicate diamond, cubic boron nitride or any other expensive abrasive. The increased efficiency of the invention is obtained by providing a plurality of spaced-apart apertures extending inwardly from the abrading surface of the matrix. The apertures have a surface and volume area such as to substantially reduce the overall or total volume of the matrix and surface area of the grinding surface containing the exposed abrasive particles. In this way a given amount of the expensive abrasive, such as diamond particles, is effectively concentrated in the solid, rigid volume of the wheel and abrasive surface, between the open areas of the apertures. The open areas of the volume of the matrix and the grinding surface constituted by the volume and cross-sectional areas of the apertures is preferably at least about 40% to about 60% of the total volume of the matrix and area of the grinding surface. Therefore, a given amount of diamond abrasive, for example, uniformly dispersed in the organic matrix, is concentrated in the rigid solid matrix between the apertures, thus effectively increasing by about 40 to 60% the concentration of diamond abrasive in the grinding surface as compared to a wheel having having a continuous grinding surface without apertures.

DETAILED DESCRIPTION OF THE INVENTION

Figure 1:
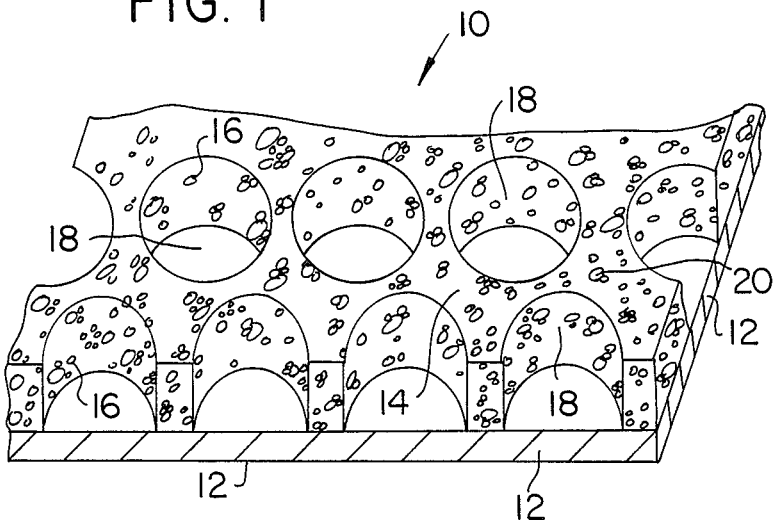
FIG. 1 is a perspective view of a section of a grinding wheel embodying a preferred embodiment of the invention.

Referring to the drawing, FIG. 1 shows a grinding wheel 10 of the invention having a suitable supporting member, such as metal plate 12, onto which a layer of a rigid organic binding material 14 is bonded. The supporting member and organic bonding matrix and the means of bonding and curing the matrix on the support member are conventional and well known in the art, and are suitably accomplished for example by casting an appropriate organic resin in a mold with the backing member setting the resin by heat or otherwise, and removing the composite article from the mold. The matrix contains a predetermined amount of diamond abrasive particles 16 uniformly distributed in the matrix. The matrix layer is provided with a plurality of spaced-apart apertures 18 extending inwardly from the operative grinding surface 20. The cross-sectional area of the apertures 18 substantially reduces the solid grinding portion of the surface 20 which wears away during the grinding operation, thus continually exposing new particles of diamond abrasive in the solid portion of the matrix. The volume of the apertures 18 provide swarf relief for the debris generated during the grinding operation. While the apertures are shown to be circular, they may have any convenient or desired cross section. In order to achieve the objects of the invention, however, the total cross-sectional area of the apertures and their total volume must substantially reduce the solid area of the grinding surface and solid volume of the rigid matrix by about 40 to about 60%, preferably by about 50%, in order to increase the effective concentration of the expensive diamond or other abrasive.

Figure 2:
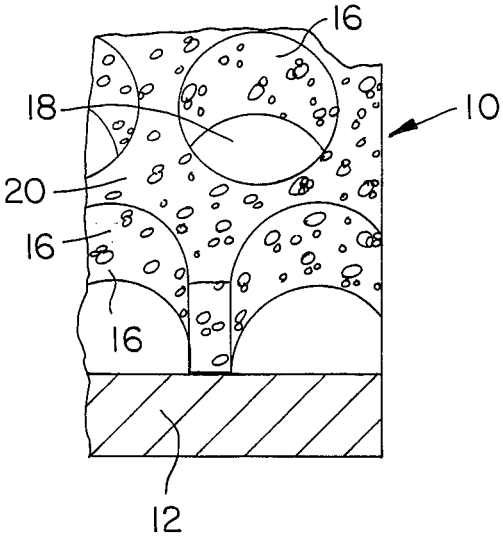
FIG. 2 is a perspective view of a portion of the wheel of FIG. 1 on an enlarged scale.

FIG. 2 shows a portion of the grinding wheel of FIG. 1 on an enlarged scale to better illustrate the relation of the diamond particles and apertures to the rigid matrix and grinding wheel. As will be seen in the drawings, a given amount of diamond abrasive is distributed in a reduced volume of matrix, due to the volume of the apertures and is thus effectively concentrated in a reduced operative area of the grinding surface, thus effectively increasing the nominal grit concentration of the wheel.

In view of the above described concept of the invention, a wheel known in the art as a 50 concentration wheel, which contains 12.5% by volume concentration of diamond abrasive uniformly dispersed in the volume of the solid organic matrix, will have its effective concentration of diamond abrasive doubled to 100 concentration (25% by volume) by providing spaced-apart apertures in the matrix having a surface area of one-half the total area of the abrasive surface. In other words, a given amount of diamond abrasive is concentrated in one-half the volume of the rigid organic matrix. Therefore, a 100 concentration grinding wheel of the present invention contains only the amount of diamond abrasive required to produce a 50 concentration grinding wheel of the prior art. Surprisingly, it has been found that the new grinding wheels, which are less costly than those of the prior art due to the reduced diamond content to provide a given effective concentration, are more efficient than those of the prior art.

It has been shown that the grinding ratio (G ratio) of the new grinding wheels is greatly increased by the effective increase in diamond grit concentration. The G ratio is the ratio of the volume of the material removed from the workpiece being ground to the unit volume of the abrasive-containing matrix of the grinding wheel which is consumed in the grinding operation. It has been found, for example, that if the volume percent of diamond in the matrix of a grinding wheel is increased to 44%, from the usual 25% or less, the G ratio can be increased as much as 1400%. However, with wheels of the prior art, such an increase in the volume percent of diamond in the matrix, quite aside from the prohibitive cost, provides the increased G ratio, only with the concomitant disadvantages of requiring increased power to drive the wheel and reduction in the rate of grinding.

The grinding wheels of the present invention., however, provide the advantageous increase in G ratio due to the increase in effective diamond concentration, but also reduce the power consumption of the wheels, while increasing the rate of grinding. All of these advantages are believed to be due to the volume and area of the apertures which permit the achievement of these advantages at a reduced cost due to the lower actual amount of diamond abrasive in each grinding wheel. For example, as noted above, if the amount of diamond abrasive in a 50 concentration wheel of the prior art (12.5% by volume) is put into a wheel of the present invention containing apertures occupying 50% of the volume of the rigid matrix and area of grinding surface, the diamond is present in only half as much solid, and the effective concentration in the wheel becomes 100 (25% by volume).

The new grinding wheels may be made in any desired size, but are generally provided in sizes from about 6 to about 24 inches in diameter. The support member may be of steel or any other suitably rigid material including other metals, plastics, ceramics and other materials having suitable properties. The overall thickness of the grinding wheels may vary within the limits known in the art but are normally in the range from about 0.060 to about 0.090 inches. The organic matrix, which may be of any suitable plastic known in the art suitably has a thickness of about 0.035 to about 0.125 inches. The thickness of the backing member is determined largely by its physical properties to obtain the desired rigidity of the wheel.

The apertures accounting for the advantages of the invention are preferably circular in the plane of the grinding surface and about 0.07 to about 0.08 in the plane of the grinding surface. The depth of the apertures spaced about 0.110 inches on center. The depth of the apertures depends upon the depth of the matrix which in turn is determined by the suitable in use life of the grinding wheel.

It will be apparent to those skilled in the art that the provision of the apertures of the invention to reduce the volume and surface area of the matrix, in any amount, will provide the advantages of the invention to a degree. However, as a practical matter, to achieve significant advantage, it is preferred to provide apertures which provide at least about 40 to about 60% reduction in volume and area, thus providing at least about 40 to about 60% increase on the effective concentration of a given amount of diamond abrasive. It is especially preferred to employ aperture volume and area amounting to about 50% of the matrix.

The following specific examples will further illustrate the advantages of the invention.

EXAMPLE 1

A grinding wheel of the invention can be produced by placing, for example, a 0.025 inch thick steel plate 6 inches in diameter in a suitable mold and introducing a suitable fluid organic resin mixture containing 50% by volume of 200 grit diamond abrasive in the mold above the steel plate. The resin mixture is then curved by heat or otherwise according to conventional procedures to produce a solid organic matrix about 0.035 to about 0.125 inches thick containing the abrasive. The mold provides apertures circular in plane of the grinding surface from about 0.07 to about 0.08, e.g. 0.077 inches in diameter spaced apart 0.110 inches on center. A six inch wheel made in this way will have about 200 apertures extending from the abrasive surface inwardly toward but terminating preferably, short of the steel plate. In this way the total volume and total surface area of the abrasive matrix are reduced about 50% so that the abrasive is concentrated in the remaining 50% of the solid matrix. Therefore, a rigid grinding wheel is produced having the same amount of abrasive that would be in a 50 concentration wheel of the prior art dispersed in half the volume of matrix and thus producing a 100 concentration grinding wheel. In other words, while the solid part of the matrix is 100 concentration due to its 50% by volume content of abrasive the amount of abrasive and therefore, cost, is half that of a 100 concentration wheel of the prior art or the same as a 50 concentration wheel of the prior art.

It has been found that the G ratio of a conventional 50 concentration wheel (12.5% diamond by volume) is 27. This means that the total removal of material from a workpiece is 27 times the volume of the grinding wheel consumed in the grinding operation. The G ratio of a nominal 100 concentration wheel of the prior art is 177, showing the increase in G ratio obtained by increasing the diamond concentration. Now in a wheel of the present invention, for example, the same amount of diamond abrasive used in the 50 concentration wheel of the prior art may be distributed in half the volume of matrix due to the presence of the apertures. Therefore, the new grinding wheel having the same amount of diamond in half the volume of grinding matrix would produce half the G ratio, or 177 divided by 2 equals 88.5, for a nominal 100 concentration wheel. Therefore, the wheel of the invention containing the same amount of diamond as the 50 concentration wheel of the prior art in half the volume of matrix has a G ratio of 88.5 as compared to the 27 G ratio of the prior art wheel. Therefore, this represents a better than 327% increase in G ratio, and corresponding amount of material removed by the same amount of diamond abrasive.

The grinding wheels of the present invention have the addition advantage that the reduced area of matrix in the grinding surface in contact with the workpiece reduces the frictional drag on the grinding wheel and thus not only the loading required, heat build-up and power required to drive the wheel.

A wide range of particle sizes may be employed in the grinding wheels of the invention depending upon their intended use. In general, however, grit sizes from about 60–80 grit (252 micron) to about 1 micron are suitable for most applications, wheels of about 200 grit diamond being generally preferred.

As is known in the art, increased concentration of diamond abrasive on a grinding wheel has beneficial effects on the surface finish of the ground article. See "Diamond Abrasives For Machining Glass" by H. Wapler and H.O. Juchem in Industrial Diamond Review 4/87. The increased effective diamond concentration provided by the new grinding wheels, thus affords superior ground finishes at reduced cost due to the lesser amount of diamond used to obtain the higher effective concentration.

Indeed, the increased diamond concentration provided by the new wheels makes possible the achievement of surface finishes unobtainable by the use of comparable grinding practices of the prior art.

EXAMPLE 2

Ceramic capacitors for certain military operations must meet specified standards for lack of porosity. The apparatus porosity of such materials is determined by optical microscopy of cross sections of samples especially ground for that purpose. Porosity appears as dark spots in the photo-micrograph of the test sample.

Figure 3:
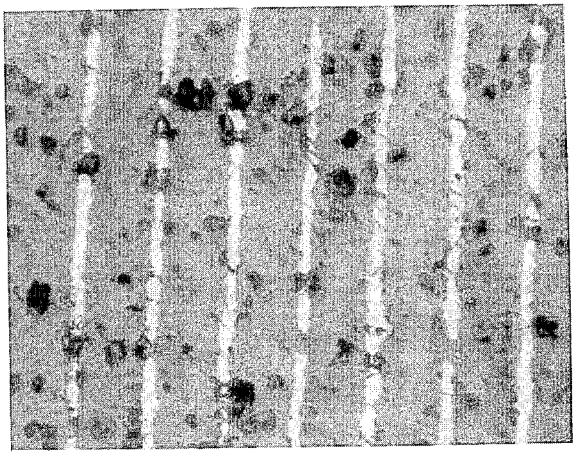
FIG. 3 is a photo-micrograph of a section of a ceramic capacitor ground by grinding wheels of the prior art.

FIG. 3 is a photo-micrograph of a ceramic capacitor ground and polished using standard procedures of grinding on a 400 grit paper disk, followed by grinding on a 600 grit paper disk, and polishing using a 1 micron A1203 past (U.S. Military Specification). FIG. 3 exhibits dark spots that appear to be pores in the gray ceramic phase. Some spots also appear in the white lines of the aluminum elements between the gray ceramic areas. Thus photo-micrograph was taken at 400 magnifications.

Figure 4:
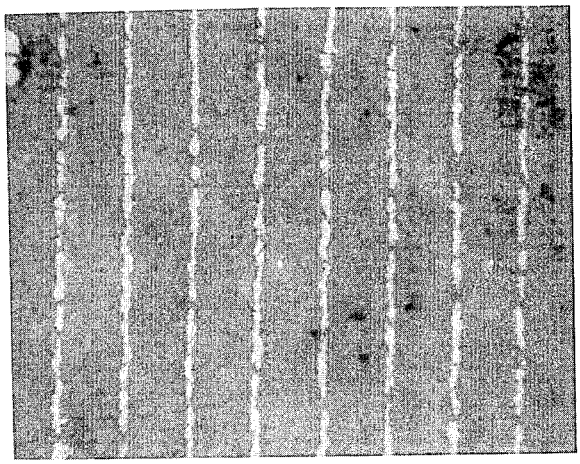
FIG. 4 is a photo-micrograph of a section of the same ceramic capacitor as that of FIG. 3, ground with grinding wheels of the present invention.

FIG. 4 is a photo-micrograph, also taken at 400 magnification, of a sample of the same ceramic capacitor, which was ground with a grinding wheel of the present invention containing 600 grit diamond abrasive in a rigid organic matrix. This initial grinding procedure was followed by grinding with a second grinding wheel of the invention containing 12 micron diamond abrasive. Both of these grinding wheels were of 50 concentration of diamond grit.

The ceramic capacitors were rejected as failing to meet the U.S. Government specifications based upon the apparent viscosity shown in FIG. 3, but when retested using the grinding wheels of the present invention, were found acceptable due to the very low apparent viscosity shown in FIG. 4.

It appeared that the grinding procedure of the prior art actually damaged the test surface by spalling the fragile ceramic material. This spalling was not removed by the polishing step so that the surface, as shown in FIG. 3, appears to have a much greater porosity than the material had in fact. The grinding procedure using the grinding wheels of the present invention did not damage the surface of the sample due to the high concentration of abrasive particles at the surface of the grinding wheel. These high concentrations of diamond grit remove smaller bits of material from the workpiece per particle of abrasive, resulting in a better surface finish with much less surface damage due to the grinding operation. It is apparent, therefore, that the grinding wheels of the present invention produce results unobtainable by the prior art with a much lower amount of diamond grit and, therefore, cost per grinding wheel.

The foregoing and other advantages of the new wheels will be apparent to those skilled in the art.

I claim:

1. In a grinding wheel having (a) a rigid matrix containing a given predetermined amount of particulate diamond or cubic boron nitride abrasive uniformly dispersed therein; and (b) a wheel grinding surface exposing said abrasive continually as the matrix wears away in grinding;

an improvement which comprises:

said grinding wheel a plurality of spaced apertures extending into the wheel from said wheel grinding surface wherein (1) each of said apertures has a generally circular area at the wheel grinding surface of about 0.07 to about 0.08 inches in diameter spaced apart about 0.110 inches from center to center and (2) the plurality of spaced apertures has a total area at the wheel grinding surface and a total volume in the wheel in the range of from about 40% to about 60% of that of a solid grinding wheel without apertures;

whereby said abrasive is concentrated in the reduced volume of the matrix, and reduced area of the matrix at the wheel grinding surface, of said wheel with said apertures, thus increasing the effective concentration of said abrasive in said matrix at the grinding surface of said wheel with said apertures in the range of about 40% to about 60%, compared to a solid, rigid grinding wheel having a continuous grinding surface without apertures and having the same said given predetermined amount of particulate diamond or cubic boron abrasive uniformly dispersed therein.

* * * * *

UNITED STATES PATENT OFFICE

CERTIFICATE OF CORRECTION

Patent No. 4,882,878 Dated November 28, 1989

Inventor(s) Robert L. Benner

It is certified that error appears in the above-identified patent and that said Letters Patent is hereby corrected as shown below:

In the Abstract:

line 3, change [cubin] to -- cubic -- line 10, change [griding] to -- grinding --

" change [this] to -- thus --

In the Specification:

Col. 1, line 49, after "clogged", remove the letter "d"

Col. 6, line 63, delete [viscosity] and add in its place -- porosity --

Col. 6, line 66, delete [viscosity] and add in its place -- porosity --

Signed and Sealed this

Twenty-ninth Day of January, 1991

*Attest:*

HARRY F. MANBECK, JR.

*Attesting Officer* *Commissioner of Patents and Trademarks*